United States Patent [19]

Jacob et al.

[11] Patent Number: 4,678,486

[45] Date of Patent: Jul. 7, 1987

[54] VACUUM CLEANER HOUSING AND DUST BAGS THEREFOR

[75] Inventors: Gernot Jacob, Weissach-Flacht; Leon Radom, Ellhofen, both of Fed. Rep. of Germany

[73] Assignee: Progress-Elektrogeräte Maux & Pfeiffer GmbH & Co., Nürtingen, Fed. Rep. of Germany

[21] Appl. No.: 786,278

[22] Filed: Oct. 10, 1985

[30] Foreign Application Priority Data

Oct. 16, 1984 [DE] Fed. Rep. of Germany ..... 3437867

[51] Int. Cl.[4] ..... B01D 46/02

[52] U.S. Cl. ..... 55/374; 55/378; 55/381

[58] Field of Search ..... 55/373–378, 55/381; 15/327 E

[56] References Cited

U.S. PATENT DOCUMENTS

| | | | |
|---|---|---|---|
| 3,088,260 | 5/1963 | Seyfried | 55/378 |
| 3,375,541 | 4/1968 | Fromknecht | 285/7 |
| 4,545,794 | 10/1985 | Himukai | 55/373 |

FOREIGN PATENT DOCUMENTS

| | | | |
|---|---|---|---|
| 1628703 | 7/1971 | Fed. Rep. of Germany | 55/373 |
| 789509 | 1/1958 | United Kingdom | 55/377 |

*Primary Examiner*—Bernard Nozick

*Attorney, Agent, or Firm*—Kline, Rommel & Colbert

[57] ABSTRACT

A vacuum cleaner housing possesses two guide means on the inner side of the end housing wall with a suction port therein in order to receive the board flange of a dust bag adjacent to the lateral housing wall. The guide means comprise guide rails each with a ramp-like wall, extending towards said housing wall, and guide ribs which are located in the lower part of the housing wall and have a slope opposite to that of the ramp-like walls. They are so shaped as to allow the board flange to be inserted between them and the walls. On introduction of such a board flange of a dust bag its lower end section is bent along a prepared line of bending, which has been formed in the lower part of the board flange parallel to its lower side. Accordingly the board flange is so firmly held in place that it is not bent by the suction force to which it is exposed. The vacuum cleaner housing is further made with a cover stop which prevents closure of the cover unless a dust bag has been previously placed in the vacuum cleaner housing.

20 Claims, 8 Drawing Figures

VACUUM CLEANER HOUSING AND DUST BAGS THEREFOR

BACKGROUND OF THE INVENTION

The invention relates to vacuum cleaner housings of the type having two guide means on the inner side of the end housing wall with the aspiration port for the reception of the board flange of a dust bag. Looked at from another aspect, the invention is furthermore concerned with board flange dust bags for use with such a housing configuration.

Vacuum cleaner housings as so far proposed having two guide rails on the inner side of the end housing wall with the aspiration opening to receive the board flange of a dust bag inserted in a downward direction have such rails placed directly to the side of the aspiration port. The main reason for this is that dust bags as so far devised have a board flange that has to be narrow for reasons of strength. Such a board flange is best made of a thin material which only has a low resistance to bending so that if the board flange of such a conventional dust bag were to be made broader it would be prone to slip off the spigot forming the aspiration port owing to the suction force acting thereon and the dust would then no longer be swept into and trapped in the dust bag and a significant fraction of it would find its way past the bag and be drawn into the motor.

The arrangement of the guide rails in the middle part of the housing complicates manufacturing the housing by molding. Furthermore, the known design suffers from the disadvantage that sometimes a substantial amount of force is required to urge the flange of the dust bag onto the spigot projecting into the housing of the suction port so that unless the user employs certain amount of skill the board flange may well be damaged.

A further shortcoming of known vacuum cleaner housings is that it is possible to close the housing cover even although there is no dust bag within the vacuum cleaner housing so that the user may well operate the cleaner unaware of the absence of a dust bag, something that may lead to a damage of the vacuum cleaner motor owing to the aspiration of dust particles into it.

SHORT OUTLINE OF THE PRESENT INVENTION

Consequently one object of the present invention is to devise a vacuum cleaner housing and a dust bag therefor of the sort in question such that the board flange of the dust bag may be simply and conveniently inserted into the vacuum cleaner housing.

In accordance with a further objective of the invention, there is at the same time to be a sealing engagement of the inserted board flange on the spigot of the aspiration port of the vacuum cleaner.

As part of a further aspect or aim of the invention, the vacuum cleaner housing is to be simpler and cheaper to produce by injection molding.

In order to achieve these or further objects the guide means are placed adjacent the side wall of the housing and the lower end section of the board flange is positively bent on insertion. Furthermore, in the lower part of the board flange there is a prepared line of bending made parallel to its lower side.

Expressed somewhat differently, it may be said that the guide means for the board flange of the dust bag are placed in the vicinity of the lateral walls of the housing where they are more easily produced by injection molding. These guide means are so constructed that the lower end section of the introduced board is positively bent. This increases the resistance of the board flange against the bending effect engendered by suction so that the board flange does not come off the spigot of the aspiration port even though the breadth of the board flange of the dust bag of the invention is considerably increased in size. In the lower part of the board flange a prepared bending line is present which is parallel to its lower side so that the board flange guided by the guiding means is bent along this line towards the interior of the vacuum cleaner housing. Owing to the large distance of the guide means from the spigot of the aspiration port projecting into the vacuum cleaner housing it is possible for the dust bag of the present invention to be simply put in place without any trouble and without any great exertion or manual skill.

It is convenient if the guide means comprise guide rails each having a ramp-like wall projecting towards the end housing wall, the distance between the front edge of the wall and the end housing wall decreasing towards the floor of the vacuum cleaner housing. This construction offers the advantage that the board flange at an angle to the end housing wall may be introduced past the spigot, extending into the interior of the housing, of the suction port without any hinderance at all.

It is an advantage if the lower edge of the ramp-like wall of each guide rail is spaced from the floor of the vacuum cleaner housing. This design creates a possibility of introduction of the lower angled end of the completely inserted board flange into the space between the lower edge of the ramp-like wall and the floor of the vacuum cleaner housing.

As an alternative to this, it is possible for the ramp-like wall to extend as far as the floor of the vacuum cleaner housing and in this case there are two cutouts in the lower edge part of the board flange to fit onto the two ramp-like walls in the bent condition of the lower part of the inserted board flange. In the case of this form of the invention the guide means are simpler and cheaper to produce.

In accordance with the invention there is the further provision that the guide means include guide ribs arranged in the lower part of the end housing wall, such ribs being oppositely inclined to the ramp-like walls of the guide rails and being so formed that the board flange of the dust bag is able to be introduced betwixt the guide ribs and the ramp-like walls bending the lower end section of the board flange. This construction means that the lower section of the board flange may be safely and reliably bent on insertion so that the board flange may readily be shifted into its ultimate position. It is best if there are two guide ribs, which have a greater distance from the lateral housing walls than the guide rails. This will effectively prevent the lower end section of the board flange being caused to bulge outwards and jam on being angulated. In order to make it possible for the dust bag to be reliably shifted into its end position it is best to have limiting ribs on the floor of the vacuum cleaner housing, against which the angled end section of the completely inserted board flange of the dust bag will then rest.

In accordance with a further advantageous feature of the invention, inwardly extending lugs are formed on the end section of the housing cover which on closing the housing cover press the board flange of the inserted dust bag over the spigot of the suction port so that the board flange assumes its sealing and operational position. The result of this is that the board flange, which is loosely introduced at an angle to the end housing wall and which is pressed by the angling of the lower end section towards the end housing wall, is positively forced into sealing engagement on the spigot of the suction port so that one may be certain that the air laden with dust particles is all aspirated into the dust bag.

In accordance with a further advantageous form of the invention there is a cover stop which prevents closing of the housing cover unless a dust bag has previously been inserted into the vacuum cleaner housing. Such a cover stop mechanism will reliably cut out any possibility of vacuum "cleaning" without any dust bag in the cleaner.

Advantageously, the cover stop may consist of a stop member pivoted on the lower side of the housing cover for motion between an active position and an inactive position, and at least one bar located on the vacuum cleaner housing and against which the stop member, when in the active position, is caused to abut on swinging the housing cover into the closed position so that it keeps the housing cover from being moved right into the closed position. The stop member has, in accord with a further feature of the invention, a spring means which rests against the lower side of the housing cover, the stop member being then in a ready-to-abut position corresponding to the relaxed condition of the spring means in the stop position, whereas in the inactive position of the stop member the spring means is tensioned.

It is convenient if the stop member consists of a transverse bar pivoted on the lower side of the housing cover, and least one bar extending from the transverse bar towards the end housing wall, such arm having the spring means and being such that on closing the housing cover it comes into engagement with the top edge of the board flange of a dust bag inserted into the vacuum cleaner housing and to be tilted in a direction opposing the force of the spring means into the inactive position, and at least one stop bar extending from the transverse bar at an angle of about 90° to the arm, such stop bar coming into engagement with the bar of the vacuum cleaner housing in the active position. In this respect the two lateral end sections of the transverse bar may each be provided with an arm and a stop bar, there being a corresponding bar then formed on the two side walls of the vacuum cleaner housing. The angle between the arms and the stop bars is best made somewhat less than 90°, since the upper edge of the board flange of a dust bag inserted into the vacuum cleaner housing is generally at a larger distance from the housing cover than the transverse bar pivoted on the lower side of the housing cover so that if there is angle of somewhat less than 90° between the arms and the stop bars of the stop member the stop bars will be generally normal to the housing cover in the closed position of the housing cover.

It is possible for a short pivot pin to be arranged on the housing cover at each of the two lateral end sections, such pins being encompassed by the female hinge members like clips formed on the transverse bar in the manner of a fork. The arms, the transverse bar and the stop bars of the stop member are preferably made integrally of synthetic resin, whereas the spring component is the form of a metal leaf spring. In such a design it is relatively simple and cheap to produce the stop member and to mount it on the housing cover so that the cover stop mechanism will not cause any increase in the price of the vacuum cleaner worth mentioning. The arms of the transverse bar have a cross section of such a size that they are not impaired in their function by the flexural loads occurring. The breadth of the arms may decrease towards their free ends in accordance with the flexural load, each arm having a center cutout in the section adjoining the transverse bar if desired.

In accordance with a further possible feature of the invention, in the active position at least one stop bar is checked by a bar formed on the side wall of the housing cover and in the inactive, non-stopping position at least one arm engages a horizontal section of a further bar formed on a side wall of the housing cover. Accordingly the active and inactive positions of the cover stop mechanism are exactly limited or defined, it being possible for the leaf spring to be slightly tensioned in the active position in order to prevent rattling of the stop member when manipulating the housing cover.

In accordance with an alternative possibility of the invention it is possible for the cover stop mechanism to consist of at least one stop member pivoted on a side wall of the vacuum cleaner housing for motion between at least two settings, and at least one associated opening in the housing cover, into which the stop member may only move when a dust bag has been already placed into the vacuum cleaner housing. Preferably the two side walls each have a stop member, there then accordingly being two openings in the housing cover.

The stop members may comprise two downwardly extending curved springs, the respectively outer spring of each stop member engaging the end housing wall of the vacuum cleaner housing and maintaining the stop member in a position in which it is not able to fit into the opening in the housing cover unless a dust bag has been inserted. The arrangement is preferably such that the respectively inner spring of each stop member is normally pressed outwards on shutting the housing cover by the board flange, pressed forwards by the lugs of the housing cover, of the dust bag in such a way that it pivots the stop member against the force of the outer spring into the position, in which it is able to enter the opening in the cover of the housing. When the dust bag is removed from the vacuum cleaner housing, then owing to the action of the outer springs resting against the end wall of the vacuum cleaner housing, the stop members will be forced back into the position in which they abut against the housing cover when it is closed and therefore keep the housing cover from being completely shut. The construction of this cover stop mechanism is particularly simple and it works positively and reliably, as is also the case with the other form of cover stop mechanism as noted above.

The dust bag in accordance with the invention has a prepared line of bending in the lower part of the board flange running parallel to its lower side. On insertion of the board flange into the vacuum cleaner housing of the invention this means that the lower section of the board flange will be so angled along the lower section of the board flange that the board flange will have a much greater resistance to bending forces. The dust bag in accordance with the invention may however by used in a vacuum cleaner housing bar any guide means which would positively bend the lower end section of the board flange. In this case the lower end section of the board flange is bent by hand prior to introduction into the vacuum cleaner housing and maintained therein in the angled position, this also preventing bending of the board flange owing to the suction force. This construction means that the board flange may have a substantial breadth in comparison with its height.

The line of bending is preferably prepared by scoring or denting the board flange.

Further features, advantages and details of the invention will be gathered from the following account of a preferred working example of the vacuum cleaner housing of the instant invention and of the dust bag.

LIST OF THE SEVERAL VIEWS OF THE FIGURES

DETAILED ACCOUNT OF WORKING EMBODIMENTS OF THE INVENTION

Figure 1:
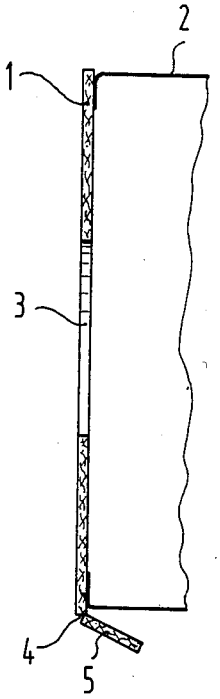
FIG. 1 is a diametral section through the board flange of a dust bag in accordance with the invention with the lower end section thereof angled or bent.

The board flange 1 depicted in FIG. 1 on the dust bag 2 (which is only shown in part) has an air inlet opening 3. In the lower part of the board flange 1 a line 4 of bending has been prepared, along which the lower end section 5 of the board flange 1 may be bent or angled as indicated.

Figure 2:
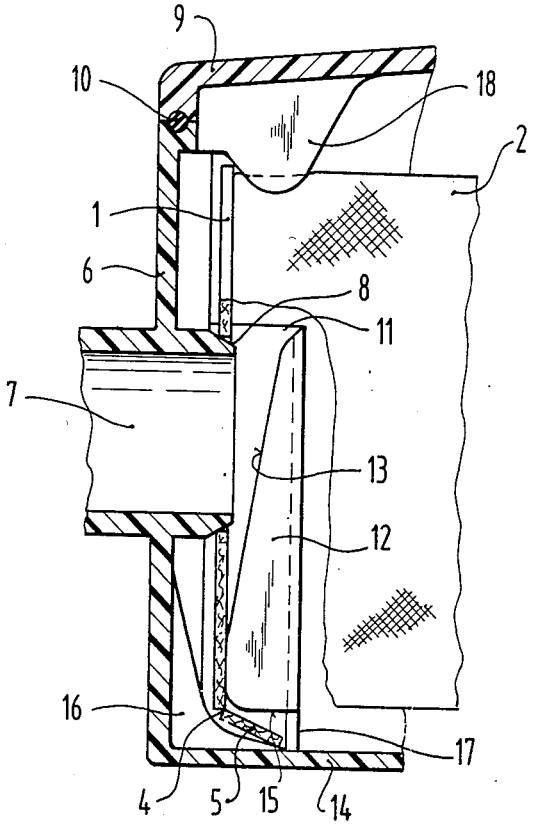
FIG. 2 is a longitudinal section through the front part of the vacuum cleaner housing of the invention in which the board flange has been inserted.
Figure 4:
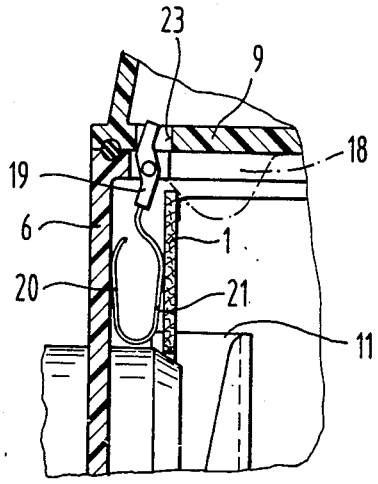
FIG. 4 shows the cover stop mechanism in the inactive condition, in which a board flange of a dust bag has been introduced into the vacuum cleaner housing.

In FIGS. 2 and 4 a part of the vacuum cleaner housing of the invention will be seen adjacent to the front housing wall 6. The end housing wall 6 has a central suction port 7 that is provided with an inwardly projecting spigot 8. A cover 9 of the housing is, when shut, jointed with the end wall 6 by virtue of a seal 10. In order to receive the board flange 1 in the housing of the vacuum cleaner there are two guide rails 11, which in each case have a ramp-like wall 12 extending toward the end housing wall 6. The distance between the front edge 13 of the wall 12 and the end housing wall 6 decreases towards the floor 14 of the vacuum cleaner housing. The lower edge 15 of the ramp-like wall 12 is spaced from the floor 14 of the vacuum cleaner housing.

In the lower part of the end housing wall 6 guide ribs 16 are formed, which have a slope opposite to that of the ramp-like walls 12. These guide ribs 16 have such a form that a board flange 1 may be inserted between them and the ramp-like walls 12, and angled or bent along the top edge of the guide ribs 16 in its lower section 5 in the process of insertion. Limiting ribs 17 are formed on the floor 14 of the vacuum cleaner housing and integrally with the guide rails 11, such ribs 17 stretching as far as the guide ribs 16 offset in relation to the guide rails 11. The bent over end section 5 of the board flange abuts these limiting ribs 17 when the board flange has been completely inserted (see FIG. 2).

Inwardly extending lugs 18 are formed on the front end section of the housing cover 9, and when the cover 9 is closed such lugs 18 force the board flange 1 over the spigot 8 of the suction port 7. Accordingly the board flange 1 is positively moved into is sealing position for operation.

On the top edge of the end housing wall 6 there are, in accordance with a first possible form of the invention, pivoting side stop members 19 forming part of a cover stop mechanism. These stop members 19 are so arranged that their up end parts project past the top edge of the end housing wall 6. The lower ends of the respective stop members 19 are each fitted with an outer curved spring 20 and an inner spring 21. The outer spring 20 engages the inner wall 6 of the vacuum cleaner housing, whereas the inner spring 21 extends into the space in the respective guide rail for the introduction of the board flange.

In FIG. 4 the reader will see a cover stop mechanism in the inactive condition, a board flange 1 being pressed by the lugs 18 of the closing housing cover in a forward direction so that for its part it forces the inner spring 21 outwards, which pivots the stop member 19 against the action of the outer spring 20 in such a way that the stop member 19 may go into an opening 23 in the housing cover 9. In this state it is possible for the housing cover 9 to be completely closed.

Figure 5:
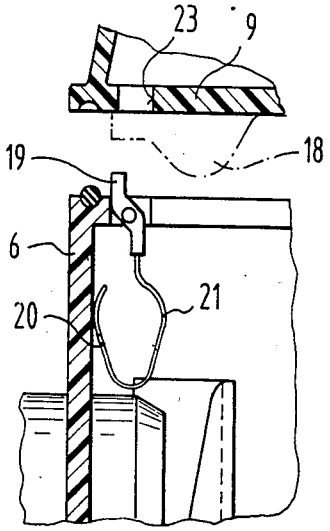
FIG. 5 shows the cover stop mechanism of FIG. 4 in the active condition prior to introduction of the board flange.
Figure 3:
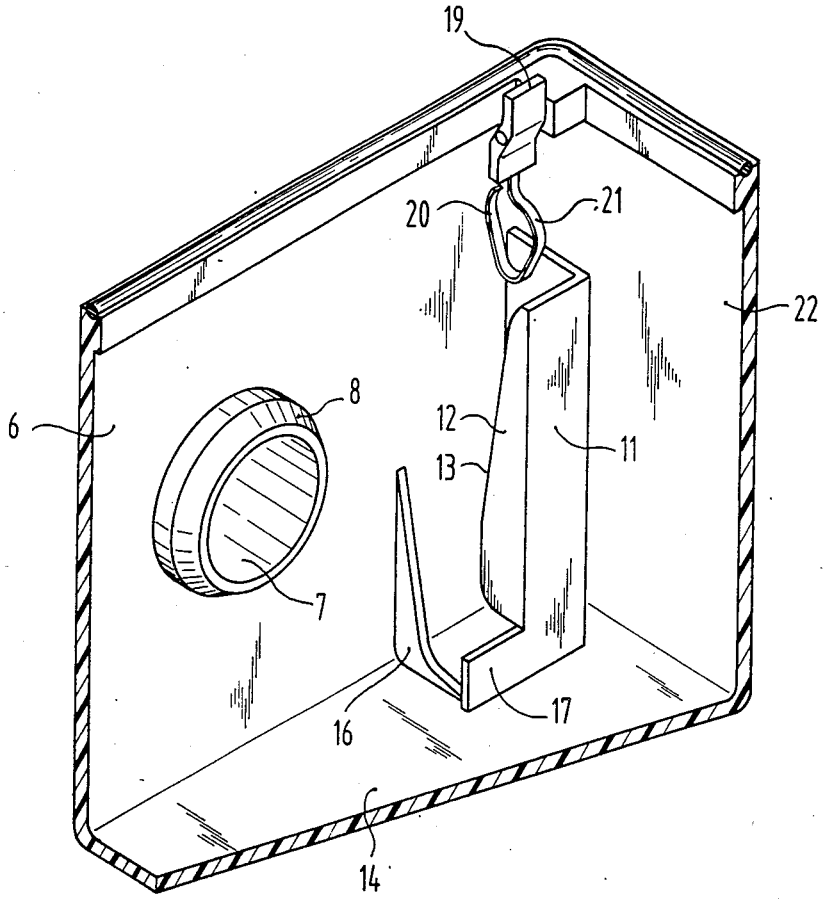
FIG. 3 is a perspective view of a part of the front of the vacuum cleaner housing of the invention with a guide means and a cover stop.

In FIG. 5 it will be seen that the stop member 19 is in the active position which it assumes when there is no board flange flange within the vacuum cleaner housing. In this case the outer spring 20, engaging the end wall 6, presses the stop member 19 into such a position that it is not able to enter the opening 23 of the closing housing cover 9 and instead it abuts against the lower side of the housing cover. Accordingly complete closure of the cover is rendered impossible.

Figure 6:
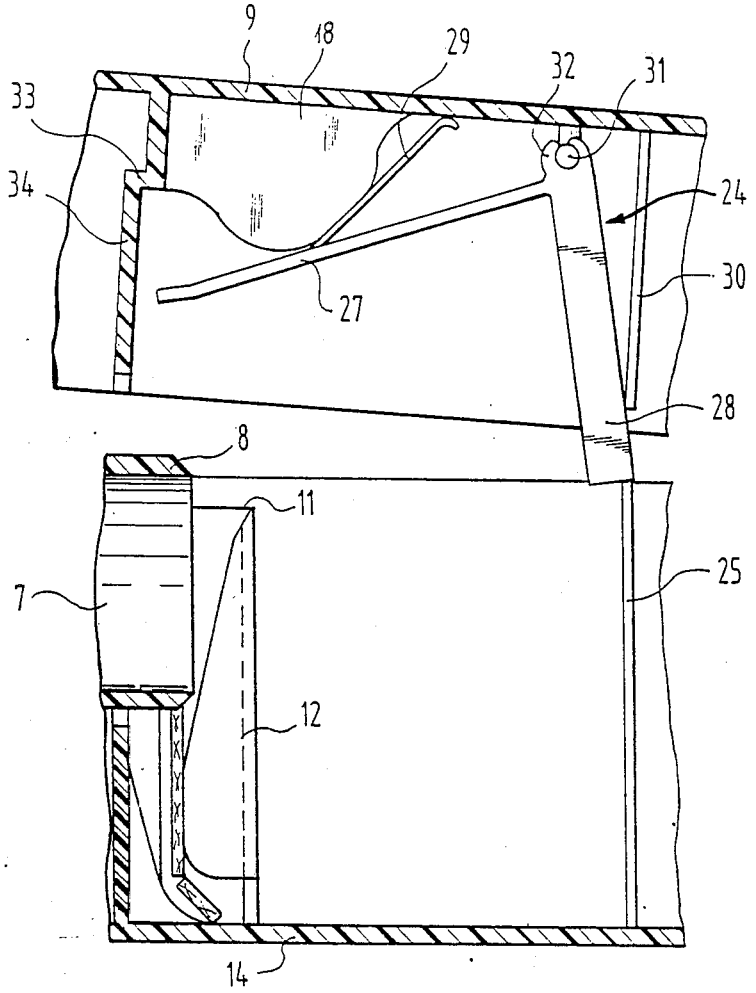
FIG. 6 is a longitudinal section through the front part of a vacuum cleaner housing of the invention with a further embodiment of a stop mechanism for the cover, as seen in the active condition.
Figure 7:
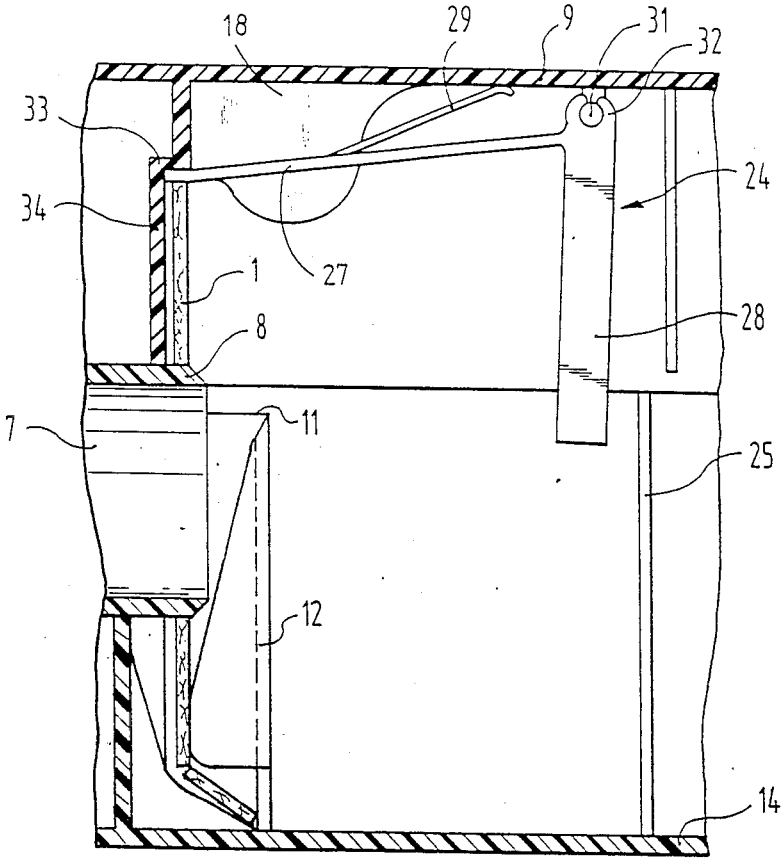
FIG. 7 shows the cover stop mechanism in accordance with the FIG. 6 in the inactive condition.
Figure 8:
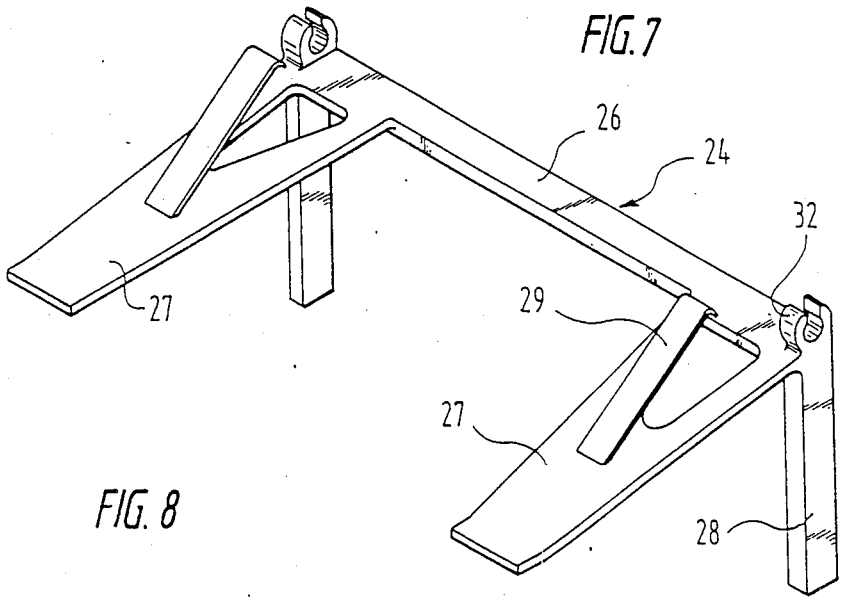
FIG. 8 is a perspective illustration of the stop member of the cover stop mechanism to be seen in FIGS. 6 and 7.

FIGS. 6 to 8 serve to show a further, preferred embodiment of a cover stop mechanism. This cover stop mechanism consists of a stop member 24 pivoted so that it may rock between an active position (FIG. 6) and an inactive or inactive position (FIG. 7). The cover stop mechanism further comprises bars 25 applied to the side walls 22 of the vacuum cleaner housing such that the stop member 24 abuts against the bars 25 in its active position on swinging the housing cover in the closing direction so that full closure of the housing cover is prevented. This condition, in which the stop member gets in the way of complete shutting of the housing cover by engaging the bars 25, will be seen in FIG. 6.

The stop member 24 consists of a transverse bar 26 at whose two end parts there is a respective arm 27 extending towards the end housing wall 6, and a stop bar 28 molded so as to be generally perpendicular thereto. The arms 27 of the transverse bar 26 are made integrally of plastic.

On the upper side of each of the arms 27 there is a leaf spring 29, same extending towards the housing cover 9 and urging the stop member 24 into the active position thereof. In such active position the stop bars 28 engage the bars 30, which are molded on the side walls of the housing cover 9 in order to exactly define the closed position of the bars 28. In this shut position the leaf springs 29 are slightly tensioned.

On the lower side of the housing cover 9 and on the two lateral end parts there are respective short pivot or hinge pins 31, which are encompassed by the female hinge parts 32 like clips molded on the transverse bar like a fork.

After opening the housing cover 9 the leaf spring 29 pivots the stop member 24 into the active position, in which the stop bars 28 engage the bars 30 of the housing cover 9. The lower end section of the stop bars 28 is, in this active position, so placed that on closing the housing cover it abuts the bars 25 and prevents a full closure of the housing cover where there is no dust bag in the vacuum cleaner housing.

In FIG. 7 the reader will see a condition in which the closing of the housing cover 9 is made possible owing to the presence of a dust bag in place. On rocking the housing cover 9 towards the closed position the front ends of the arms 27, as pivoting takes place, strike the top edge of the board flange 1 of the inserted dust bag so that the stop member 24 is turned on the pins 31 into the inactive position against the force of the springs 29. In this liberated position the stop bars 28 are no longer slanted obliquely backwards and in engagement with the bars 25, but rather run approximately at a right angle to the housing cover 9, this enabling closing of the cover. The inactive position of the stop member 24 is limited by a horizontal section 33 of a further bar 34 formed on the side wall of the housing cover 9.

What is claimed is:

1. A vacuum cleaner including a housing having a floor, side walls, a cover, and an end wall provided with an inwardly projecting spigot defining a suction port, and a dust bag including a board flange having a prepared line of bending and an air inlet opening for operative engagement with said spigot in a manner so that dust may be received through said suction port and into said dust bag, spaced apart guide means mounted on said housing for providing controlled deformation of said board flange along said line of bending thereof and operational seating of said air inlet opening thereof onto said suction port, and lug means mounted on said cover or abutment with said board flange whereby to move said board flange along said guide means for deformation of said board flange along said line of bending thereof and urging said air inlet opening thereof onto said spigot for operative engagement therewith.

2. A vacuum cleaner as claimed in claim 1 comprising a movable cover with an end section, said end section having inwardly projecting lugs adapted to seat said board flange of said dust bag against said spigot.

3. A vacuum cleaner as claimed in claim 1 wherein said guide means each comprise a guide rail each having a ramp-like wall extending toward said end wall in juxtaposition for guiding said board flange in a direction for deformation of said board flange along said line of bending thereof, the distance between said ramp-like walls and said end wall of said housing decreasing toward said floor of said housing.

4. A vacuum cleaner as claimed in claim 3 wherein each of said ramp-like walls of said guide rails ends short of said floor of said housing.

5. A vacuum cleaner as claimed in claim 3 wherein each said ramp-like wall extends as far as said floor of said vacuum cleaner housing.

6. A vacuum cleaner as claimed in claim 5 wherein the lower part of said board flange has spaced apart cut-outs for fitting onto said ramp-like walls of said guide means in the deformed condition of said board flange.

7. A vacuum cleaner as claimed in claim 3 wherein in a lower part of said end housing wall said guide means comprise guide ribs having a slope opposite to the that of the ramp-like walls of the guide rails and being so formed that the board flange of the dust bag may be slipped into place between the guide ribs and the ramp-like walls with a bending of a lower end section of said board flange to form a bent part of said flange.

8. A vacuum cleaner as claimed in claim 7 comprising two such guide ribs having a greater distance from said side housing walls than said guide rails have therefrom.

9. A vacuum cleaner as claimed in claim 7 wherein said guide means further comprise limiting ribs placed on said floor of said housing so that when said board flange is fully introduced said bent part thereof abuts said limiting ribs.

10. A vacuum cleaner as claimed in claim 1 wherein said housing includes a cover stop to prevent closing of said cover absent a dust bag in said housing.

11. A vacuum cleaner as claimed in claim 10 wherein said cover stop comprises at least one stop member pivoted on a side wall of said vacuum cleaner housing for swinging motion between two positions, said housing cover having at least one opening in said housing cover which may only be entered by said stop member when a dust bag is present in said vacuum cleaner housing.

12. A vacuum cleaner as claimed in claim 11 wherein said stop member comprises an inner curved and and outer curved spring, of which the outer spring abuts a wall of said housing to urge said stop member into said active position in which it is unable to enter said opening in said cover of said vacuum cleaner housing absent a dust bag in said housing so that closure of said housing cover is prevented, and the inner spring of said stop means is so pressed towards the said end wall on closing said cover by lugs formed on said that it rocks said stop member against the force of the said outer spring into the inactive position in which said stop member fits into said opening.

13. A vacuum cleaner as claimed in claim 10 wherein said cover stop comprises a stop member mounted on a lower side of said cover and adapted to pivot between an active and inactive position, and at least one locating bar placed on the housing, against which the stop member abuts in the said active position when the said cover is moved in a closing direction so that rocking motion of the housing cover is arrested before it is able to reach a closed position thereof.

14. A vacuum cleaner as claimed in claim 13 wherein in said active position of said stop member at least one stop bar abuts a side wall of said housing cover and in said inactive position at least one arm abuts a horizontal section of a further bar formed on a side wall of the housing cover.

15. A vacuum cleaner as claimed in claim 13 wherein said stop member comprises a spring means adapted to abut a lower face of said cover, said spring means being generally relaxed when said stop member is in said active position, whereas in the inactive position of the stop member the spring means is tensioned.

16. A vacuum cleaner as claimed in claim 15 wherein said stop member comprises a transverse bar pivotally mounted on a lower face of said housing cover, at least one arm extending from the said transverse bar towards said end wall of said housing, said arm being equipped with said spring means and being adapted, on moving said cover in the closing direction thereof, to abut the upper edge of a dust bag inserted into said vacuum cleaner housing so that it is swung against the force of said spring means, and and at least one stop bar extending from the transverse bar at an angle of approximately 90° to the said arm, said stop bar abutting said locating bar in the arrested position of said cover.

17. A vacuum cleaner as claimed in claim 16 wherein said arms, the transverse bar and the stop bars form part of a single integral plastic structure and wherein said spring means is in the form of a leaf or strip spring.

18. A vacuum cleaner as claimed in claim 16 comprising, formed on lateral end sections of said transverse bar, a respective arm and a stop bar, and furthermore, on two side walls of said vacuum cleaner housing, a corresponding bar for cooperation with said stop bar.

19. A vacuum cleaner as claimed in claim 18 comprising short pins on two lateral end parts encompassed by clip-like parts on said transverse bar.

20. A dust bag including a board flange having an air inlet opening for operative engagement with the suction port of a vacuum cleaner housing in a manner so that dust may be received through the suction port and into the dust bag, said board flange having a section adapted to fit within the vacuum cleaner housing so as to be lower down than the rest of said board flange, said section having a prepared line of bending parallel to a lower edge of said board flange.

* * * * *